US011781334B1

(12) United States Patent
Sarpolis

(10) Patent No.: US 11,781,334 B1
(45) Date of Patent: Oct. 10, 2023

(54) SUBMERSIBLE POOL AND SPA CLEANING SYSTEM

(71) Applicant: John William Sarpolis, Santa Barbara, CA (US)

(72) Inventor: John William Sarpolis, Santa Barbara, CA (US)

( * ) Notice: Subject to any disclaimer, the term of this patent is extended or adjusted under 35 U.S.C. 154(b) by 70 days.

(21) Appl. No.: 17/300,229

(22) Filed: Apr. 19, 2021

(51) Int. Cl.
*E04H 4/16* (2006.01)

(52) U.S. Cl.
CPC ..... *E04H 4/1636* (2013.01)

(58) Field of Classification Search
CPC ..... E04H 4/1636
USPC ..... 210/167.16, 167.17, 232, 238, 416.1, 210/416.2; 15/1.7
See application file for complete search history.

(56) References Cited

U.S. PATENT DOCUMENTS 3,820,182 A * 6/1974 Vockroth ..... A47L 13/00 210/167.16
4,589,986 A * 5/1986 Greskovics ..... E04H 4/1654 55/374
4,962,559 A * 10/1990 Schuman ..... E04H 4/1618 15/350
5,472,517 A * 12/1995 Laberge ..... E04H 4/1636 15/345
6,412,133 B1 * 7/2002 Erlich ..... E04H 4/1663 15/1.7
6,971,136 B2 * 12/2005 Horvath ..... E04H 4/1654 210/167.17
8,709,245 B2 * 4/2014 Hui ..... E04H 4/1654 210/167.17
8,956,533 B2 * 2/2015 Gopalan ..... E04H 4/1663 210/167.16
9,856,666 B2 * 1/2018 Laydera-Collins ... E04H 4/1636
11,060,311 B2 * 7/2021 Begic ..... E04H 4/1636
2005/0126969 A1 * 6/2005 Dolton, III ..... E04H 4/1609 210/167.17

* cited by examiner

*Primary Examiner* — Fred Prince
(74) *Attorney, Agent, or Firm* — Derrick Reed

(57) ABSTRACT

An apparatus for cleaning a body of water includes a housing defining an interior passageway, with a mesh catch bag connected at the upper end of the inner passage. A power source and a submersible pump are electrically connected, and both connect to the housing. The pump draws water from the body of water, and directs it to a plurality of openings oriented on an inner surface of the housing. The openings direct water upwardly through the inner passage of the housing and through the catch bag, thereby drawing debris from beneath the housing upwardly through the housing and into the catch bag.

20 Claims, 9 Drawing Sheets

FIG.4
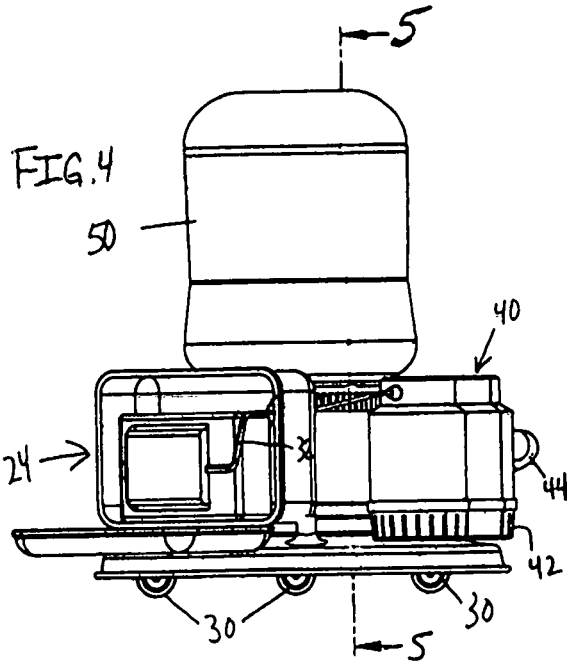
60 FIG.6
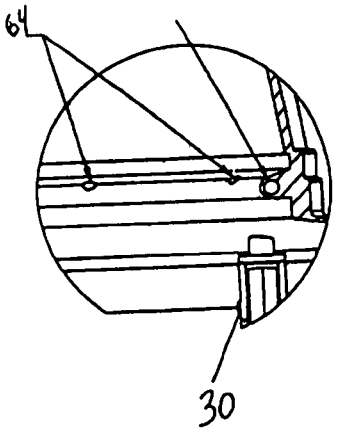
FIG.5
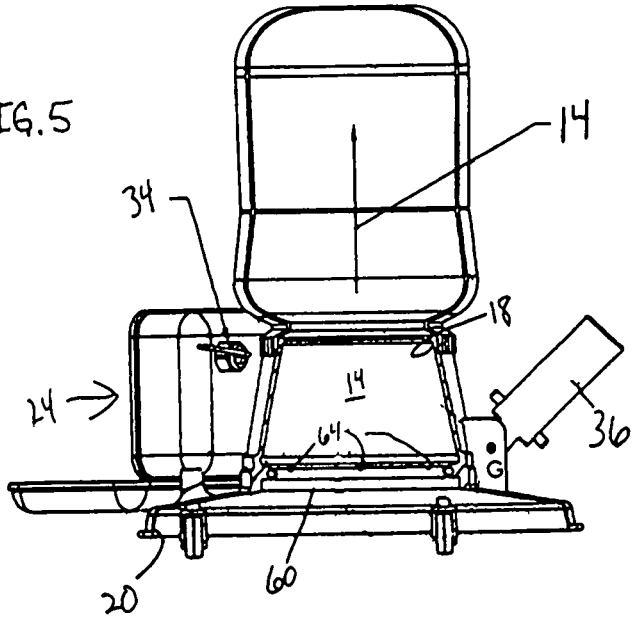

FIG. 11
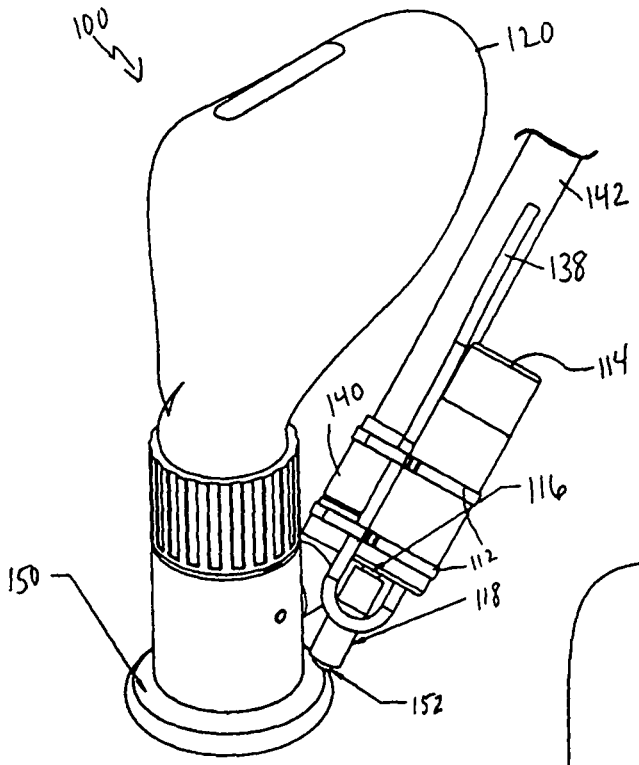
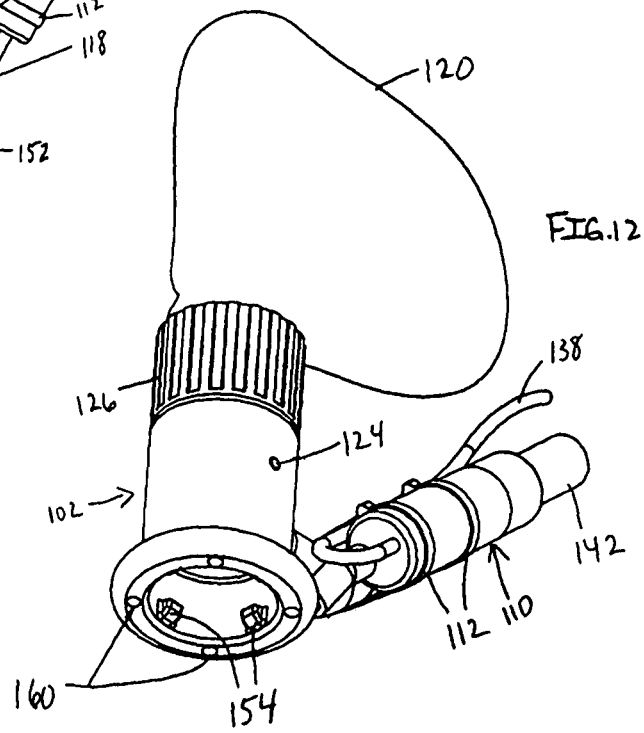
FIG. 12

FIG. 13
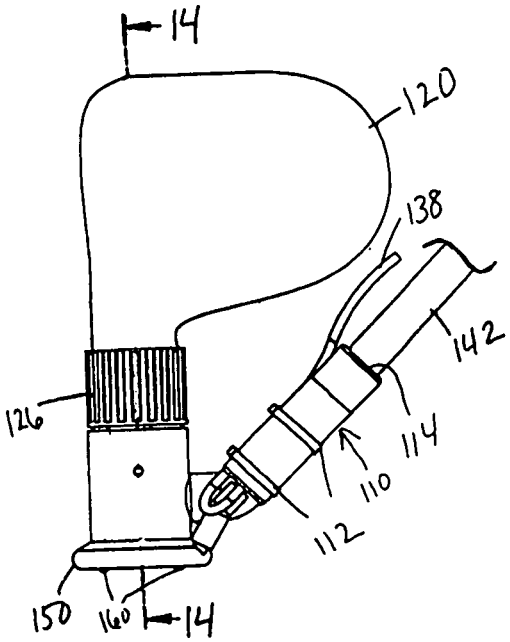
FIG. 14
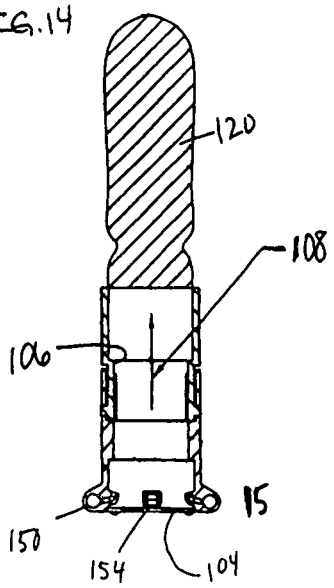
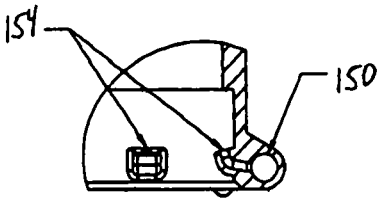
FIG. 15

SUBMERSIBLE POOL AND SPA CLEANING SYSTEM

TECHNICAL FIELD

The present invention relates to systems for cleaning debris from pools, spas, fountains, and the like and, more particularly, to a system that creates a vacuum to effect the cleaning of said water.

BACKGROUND

Many households and businesses have pools, spas, fountains, and other water features. As with any other structure, these water features require maintenance and upkeep. Pools and fountains especially can collect leaves and other debris that ultimately rest on the bottom surface of the water feature. The debris is unsightly and in the case of pools, diminishes the user experience. Moreover, the debris, if left in the water feature for an extended period of time, will eventually clog up pipes and compromise the performance of pumps and filters incorporated into the water feature. Thus it is highly desirable to periodically remove the debris that gathers in a water feature, often on a weekly basis.

Homeowners and businesses will often hire a pool and spa service company to maintain the water feature. The service company ensures that the equipment is operating correctly, and also cleans the water feature to remove the debris. Often this task of cleaning the water feature takes a significant amount of time. Thus, any tool that can minimize the amount of time required to clean the water feature is highly desirable.

Many pool service companies use a conventional mesh net connected to a long pole, and simply push the net along the bottom surface of the pool in an attempt to catch all of the debris. Pushing such a device along the bottom of the pool can agitate the debris, causing it to rise up into the middle of the water, making the cleaning even more difficult and time consuming, and also tending to make the water murky and unsightly. In addition, flat leaves and other small debris sitting on the bottom of the pool can be somewhat challenging to collect with such a device, thereby reducing the efficiency of the service company.

Others have proposed devices that connect to a garden hose and use the water from the garden hose to create a suction force that collects the debris. Such a device requires a hose and hose bib, and setting up such a system reduces efficiency, especially for a pool service person who is not familiar with the location they are servicing. In addition, some locations lack the required water pressure to effectively power such a device, thereby further limiting the utility of those devices.

Still others have proposed unwieldy devices that incorporate fans that, when activated, pull water through a housing thereby drawing debris through the housing and ultimately into a mesh bag to collect the unwanted debris. These devices consume a relatively large amount of energy and therefore typically have an electrical cord and plug to be connected to an electrical outlet at the residence. Obviously this is a problem when there is no available outlet to use. In addition, as with any relatively complicated device that includes moving parts, these devices are more likely to break down and require repair or replacement than more straightforward, elegant solutions.

Thus what is needed is a system that can quickly and efficiently remove the debris from a water feature, and that is portable, light weight, and easy to set up and use.

Moreover, what is needed is a system that is fully self-contained and does not require attachment to a hose or electrical outlet to perform its function. The present invention satisfies these needs.

SUMMARY

In one embodiment, an apparatus for cleaning a body of water includes a housing defining an inner passage, with a mesh catch bag releasably connected at the upper end of the inner passage. A power source and a submersible pump are electrically connected, and both connect to the housing. When activated, the pump draws water from the body of water, and directs it to a plurality of openings oriented on an inner surface of the housing. The openings direct water upwardly through the inner passage of the housing and through the catch bag.

In another embodiment, an apparatus for cleaning a body of water includes a housing defining an inner passage, with a catch bag releasably connected to the top of the housing. A power source and submersible pump are mounted to the housing. The housing further defines an annular manifold with a plurality of openings oriented into the inner passage. The pump is in fluid communication with the manifold and pumps water from the body of water into the manifold, which is configured to expel the water through the openings in a generally upward direction through the inner passage and catch bag.

In yet another embodiment, an apparatus for cleaning a body of water includes a generally cylindrical housing defining a cylindrical inner passage through the housing. A pump and power source are electrically connected, and the pump connects to an inlet in the housing to pump water through the inlet and into an annular manifold. The manifold defines a plurality of openings that direct the water through the inner passage and out through the upper opening of the housing.

DESCRIPTION OF THE DRAWINGS

FIG. 4 is a front side plan view of the apparatus of FIG. 1;

FIG. 5 is a cross-sectional view taken along the line 5-5 of FIG. 4;

FIG. 6 is an enlarged view of the region labeled 6 of FIG. 5;

FIG. 11 is a perspective view of the apparatus of FIG. 7;

FIG. 12 is a perspective view showing an underside of the apparatus of FIG. 7;

FIG. 13 is a right side plan view of the apparatus of FIG. 7;

FIG. 14 is a cross-sectional view taken along the line 14-14 of FIG. 13; and FIG. 15 is an enlarged view of the region labeled 15 of FIG. 14.

To facilitate understanding of the invention, like reference numerals have been used to refer to like elements throughout the figures.

DETAILED DESCRIPTION

The invention is described in the context of devices for cleaning water features such as pools, spas, and fountains. However, those of ordinary skill in the art will understand that the invention has applicability in any body of water, such as tanks, ponds, and the like.

Figure 1:
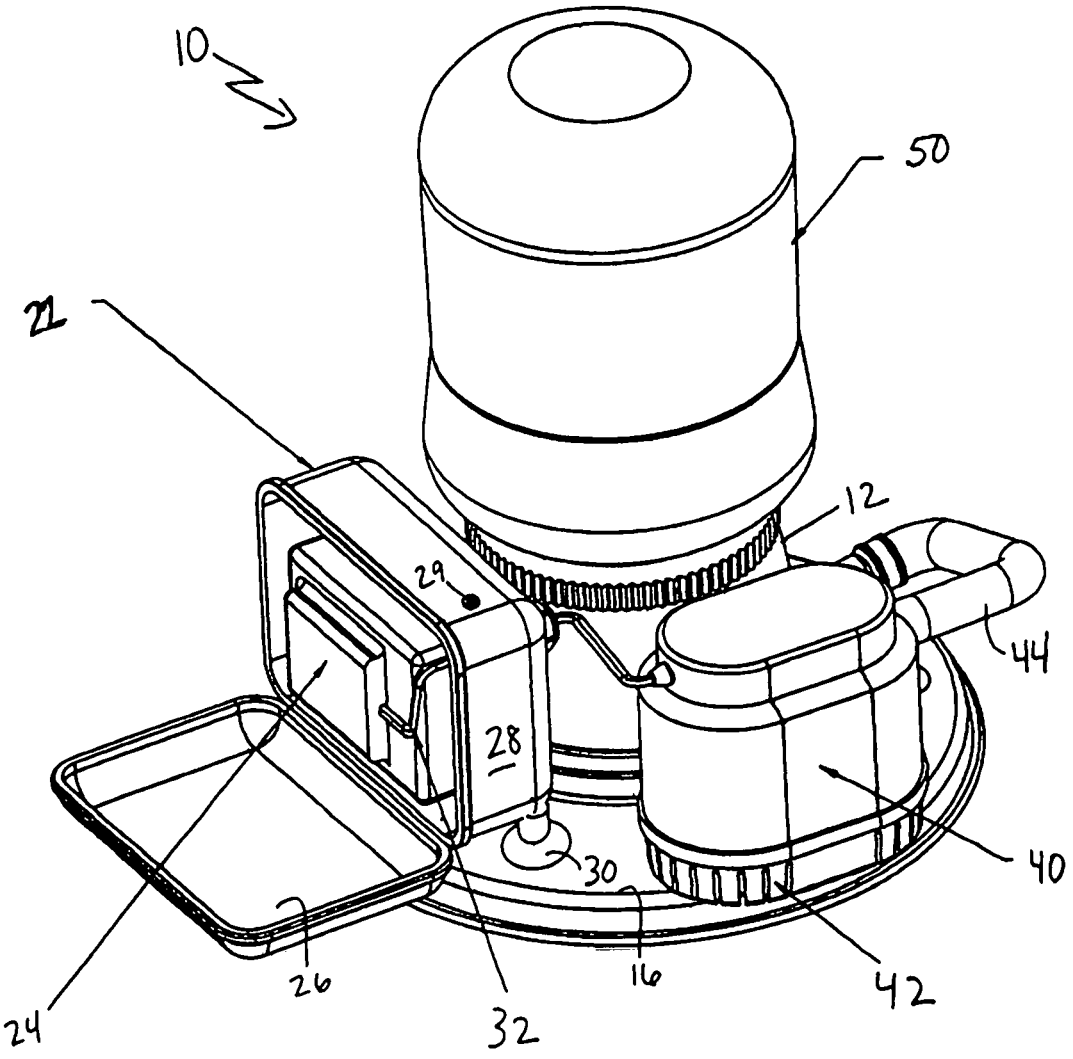
FIG. 1 is a perspective view of an apparatus according to one preferred embodiment.

In one embodiment, as shown in FIG. 1, an apparatus 10 comprises a self-contained water cleaning device for cleaning a body of water. Apparatus 10 comprises a housing 12 that defines an interior cavity functioning as an interior passageway 14. Housing 12 further defines a bottom flange 16. Housing 12 defines an upper opening 18 and bottom opening 20 of the interior cavity 14, wherein in one embodiment the bottom opening 20 is wider than the upper opening 18. Mounted to flange 16 is a battery housing 22 which contains a battery 24. In one embodiment the battery 24 is a rechargeable battery. Battery housing 22 comprises a hinged lid 26 and storage compartment 28, and a power switch or button 29 to activate the battery 24. Hinged lid 26 comprises a gasket to effect a watertight seal when battery housing 22 is closed. In one embodiment the battery 24 comprises a 20 volt battery from Dewalt Industrial Tool Company, but it will be readily understood by those having ordinary skill in the art that a wide range of batteries are suitable for use in the present invention.

In one embodiment, battery housing 22 comprises a watertight housing including storage compartment 28 and a lid (not shown) that is screwed onto the compartment 28 and includes a gasket or other well known means for making a watertight seal between the compartment 28 and lid. In this embodiment, battery housing 22 comprises the bulkhead 34 to allow the wire harness 32 to exit the housing 22 while maintaining the watertight nature of housing 22.

Also mounted to flange 16 is a submersible pump 40. The pump 40 can be of any suitable type, and in one embodiment comprises an impeller type pump. Pump 40 comprises a pump intake grate 42 at the bottom of the pump housing, which prevents debris from entering the pump, and supplies water to the pump. The pump further connects to a pump outlet port 44 which supplies pressurized water to the housing 12 as described in greater detail below.

The upper opening 18 of housing 12 connects to a mesh catch bag 50 to collect the debris that flows through the inner passage 14. As shown in FIG. 1, the upper opening 18 is narrower than the bottom opening 20 thereby defining a tapered inner passage 14, which provides a larger cross-section at the bottom opening 20 for collecting debris, and a smaller upper cross-section to improve the flow rate through the upper opening 18. While the cross sectional shape of housing 12 is circular, it will be understood by those skilled in the art that the shape could be elliptical, square, or any other suitable shape.

Again referring to FIG. 1, battery 24 is electrically connected to the motor of pump 40 by means of a wire harness 32. Wire harness 32 passes through a watertight bulkhead 34 on the side of battery housing 22 and then connects to the pump 40 to supply power to the pump motor, as described in greater detail below. In one embodiment, pump 40 includes a float switch (not shown) to automatically activate battery 24 when apparatus 10 is submerged into a body of water. In another embodiment, battery 24 can be activated by the power switch 29.

Figure 2:
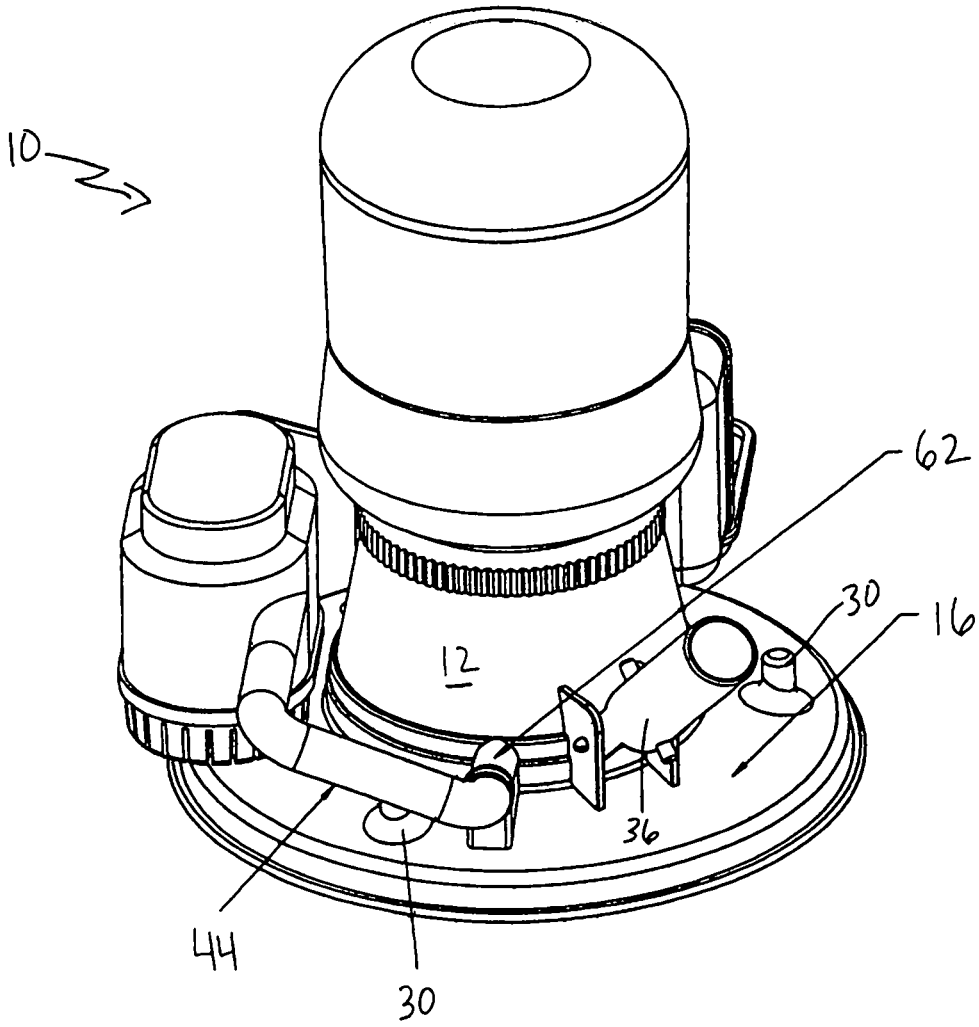
FIG. 2 is a right side perspective view of the apparatus of FIG. 1.
Figure 3:
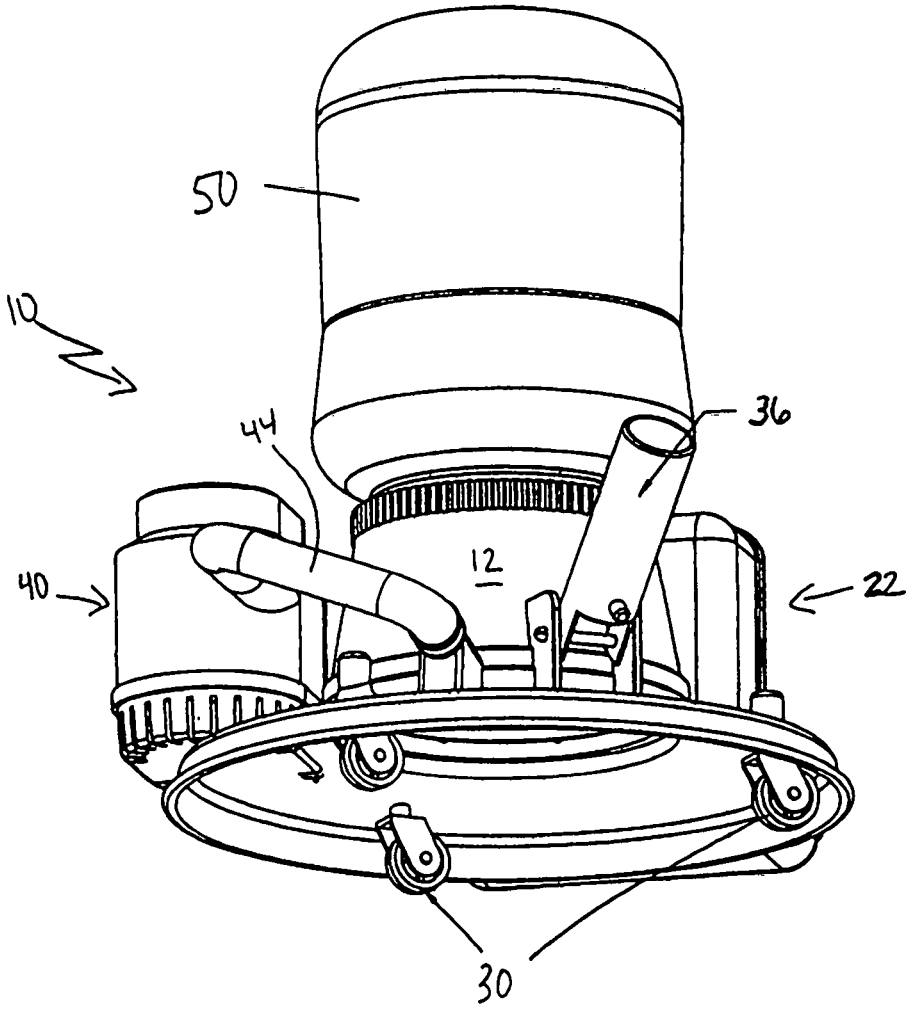
FIG. 3 is a rear perspective view of the apparatus of FIG. 1.

Referring now to FIG. 2, housing 12 further includes a pivotable handle mount 36, which is configured to receive an elongated handle (not shown). The handle can be releasably, telescopically inserted into the handle mount 36 by any suitable means, including detent springs, by being press fit together, with a threaded connection, or any other well known means of releasably connecting the two in a male-female engagement.

Apparatus 10 further includes a plurality of spaced apart, swivel caster wheels 30. Wheels 30 provide a number of functions, including allowing the housing 12 to easily travel along the bottom surface of a body of water. In addition, the wheels 30 provide a separation between the bottom opening 20 of housing 12 and the bottom surface of the body of water. In this manner, leaves and other debris can pass underneath housing 12 and into alignment with the inner passageway 14, where they can then be drawn through the interior passageway 14 as described in more detail below.

As shown in FIG. 4, the handle mount 36 is placed on a generally diametrically opposed side of housing 12 from the battery 24 and pump 40. This provides a front-end weight to the housing 12, which keeps the housing 12 from floating through the water, but rather keeps apparatus 10 in better contact with the bottom surface of the body of water as it is maneuvered through the water, thereby improving the performance of the device.

Referring now to FIGS. 5 and 6, housing 12 comprises an annular manifold 60 adjacent to the bottom opening 20. The manifold 60 is in fluid communication with pump outlet tube 44 via manifold inlet 62 (FIG. 2). The manifold is provided with a number of openings 64 that function as high-pressure water jets to force high-pressure water upwardly through the inner passageway 14. In one embodiment, the jets 64 are formed directly in the manifold wall and oriented at an angle of between approximately 5 and 20 degrees; in one specific embodiment jets 64 are oriented at an angle of approximately 17 degrees relative to the vertical axis. In another embodiment, as shown in FIG. 15, the jets 64 can alternatively be formed as generally J-shaped conduits 154 that extend into the interior passageway 14 and then angle upwardly at the desired angle, between approximately 5 and 20 degrees and preferably approximately 11 degrees. The angle of the jets 64 can vary depending on the number of jets, size of the openings, size of housing 12, and other factors, but preferably will be in the range of approximately 5 to 20 degrees relative to the vertical axis. In one specific embodiment, the jets 64 are oriented such that the spray from each jet 64 is directed to pass through the axis of housing 12 as the water passes out of the inner passageway 14 through the upper opening 18.

The size of the openings 64 can vary from approximately ⅛ to ¼ inches, and in one preferred embodiment they comprise approximately 3/16" openings. The number of openings 64 can vary from 5 to 8 openings, and in one embodiment there are seven openings, uniformly spaced around the manifold 60. Manifold 60 comprises an annular tube where the inner diameter of the tube ranges between approximately ⅜ and ⅝ inches; in one specific embodiment manifold 60 comprises a tube having an approximately ½" inner diameter.

In operation, the apparatus 10 of FIGS. 1-6 is submerged into a pool or other body of water with the battery 24 powering the submersible pump 40. The operator of the apparatus 10 uses the elongated handle (not shown) to guide the apparatus 10 along the bottom surface of the pool. The jets 64 direct high pressure water inwardly and upwardly through the interior passageway 14 at an angle determined by the angle of the jets 64, thereby forcing water within the interior passageway 14 to flow upwardly and out of the upper opening 18 and through the mesh catch bag 50. This creates a vacuum within the interior of the housing 12, which causes water from beneath the housing 12 to be drawn up into the housing, along with any nearby debris. The continual action of the jets 64 forces this debris-filled water into and through the interior passageway 14, out of the upper opening 18 and into the catch bag 50, where the debris is contained. In this manner, debris is pulled into the housing, even debris that is not directly underneath the housing 12. This allows a pool to be cleaned quickly and easily, without the agitation of debris as described above.

Figure 7:
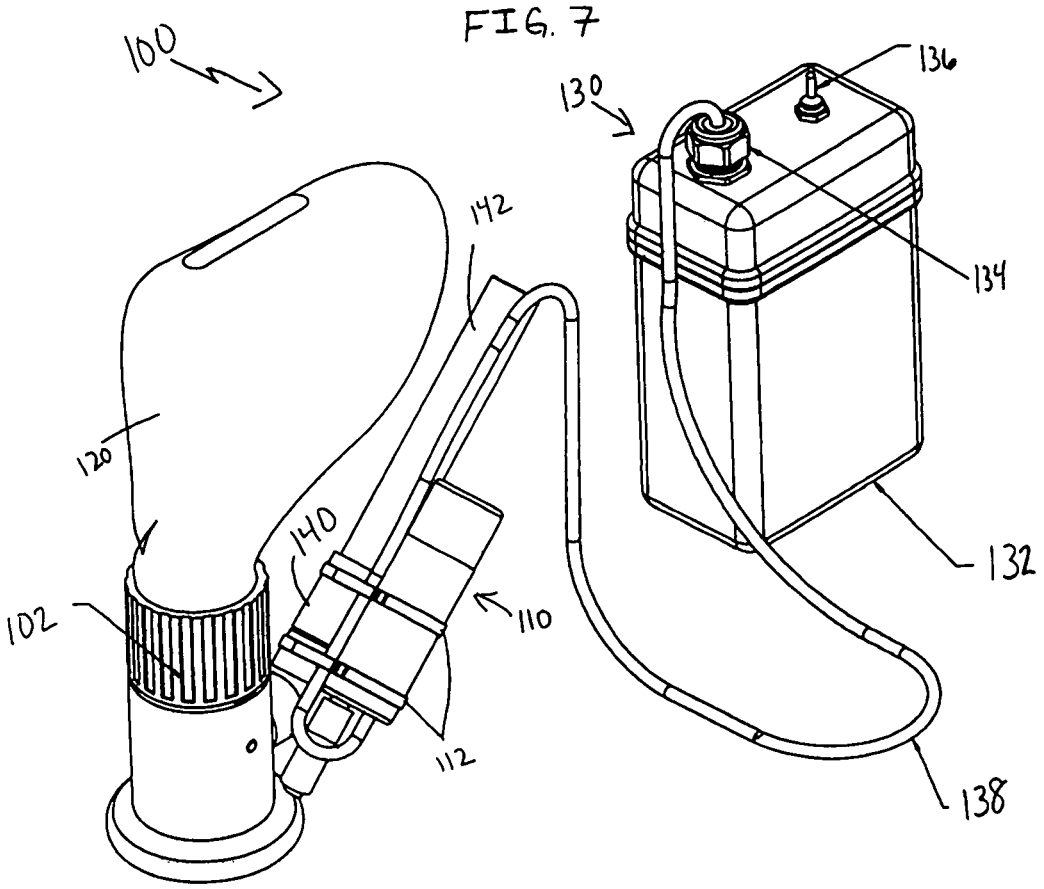
FIG. 7 is a perspective view of an apparatus according to another preferred embodiment.

Referring now to FIG. 7, another embodiment of the invention is shown. Apparatus 100 is relatively small compared to apparatus 10, having a relatively small footprint, and is useful in smaller bodies of water such as spas and small fountains. Apparatus 100 comprises a generally cylindrical housing 102 defining a lower opening 104 and upper opening 106 and an inner passageway 108 therethrough. A submersible pump 110 is connected to housing 102 to supply pressurized water to the housing 102, as described in greater detail below. A mesh catch bag 120 is releasably connected to the upper opening 106 via detent springs as described in more detail below in connection with FIGS. 9 and 10.

Apparatus 100 further comprises battery assembly 130. Battery assembly 130 comprises a watertight housing 132 housing a rechargeable battery inside. Housing 132 includes a watertight bulkhead 134 and watertight power switch 136 to activate the battery. Extending through the bulkhead 134 is an elongated wire harness to supply electrical power from the battery assembly 130 to pump 110. In this embodiment, the battery assembly 130 can be connected to housing 102, but can also be clipped to the handle or worn by the operator via a belt clip or in any other well known manner.

Apparatus 100 further comprises a handle mount 140 to connect an elongated pole 142 to apparatus 100 to allow an operator to maneuver apparatus 100 while it is underwater. In one embodiment, pump 110 is strapped to the handle mount 140 by means of a plurality of pump straps 112. It will be understood by those skilled in the art that pump 110 can be fixedly mounted to apparatus 100 in any suitable means, including via a threaded fluid coupling or other means.

Figure 8:
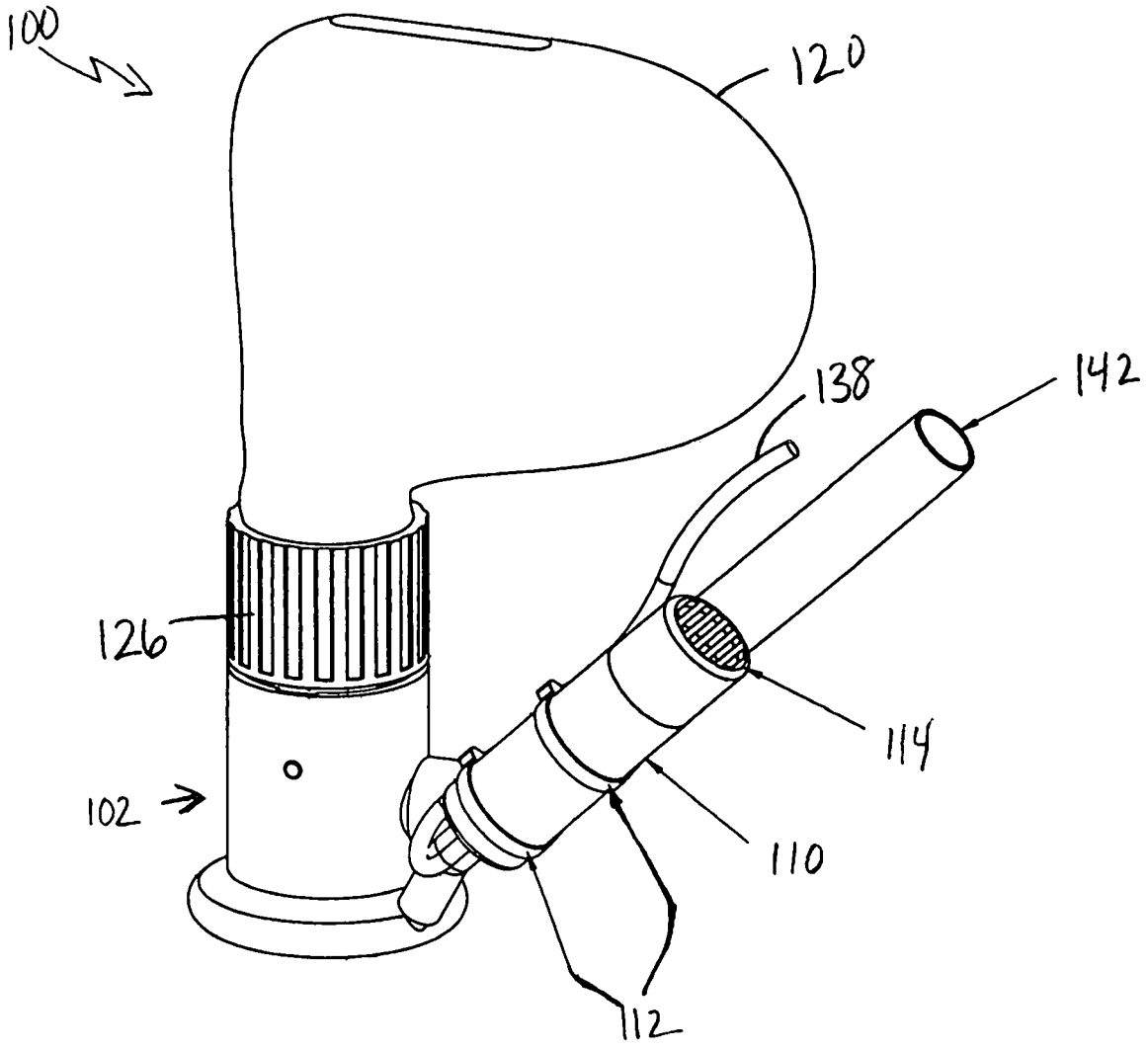
FIG. 8 is a right side perspective view of the apparatus of FIG. 7.

Referring to FIG. 8, submersible pump 110 comprises a pump intake grate 114 that filters debris from the water supplied to the interior of the pump 110. Pump 110 can be of various types, but in one embodiment is an impeller type pump. Pump 110 includes an electric motor (not shown) that is electrically connected to, and energized by, the wire harness 138 to drive the impeller which forces pressurized water into the housing 102, again as described in greater detail below.

Figure 9:
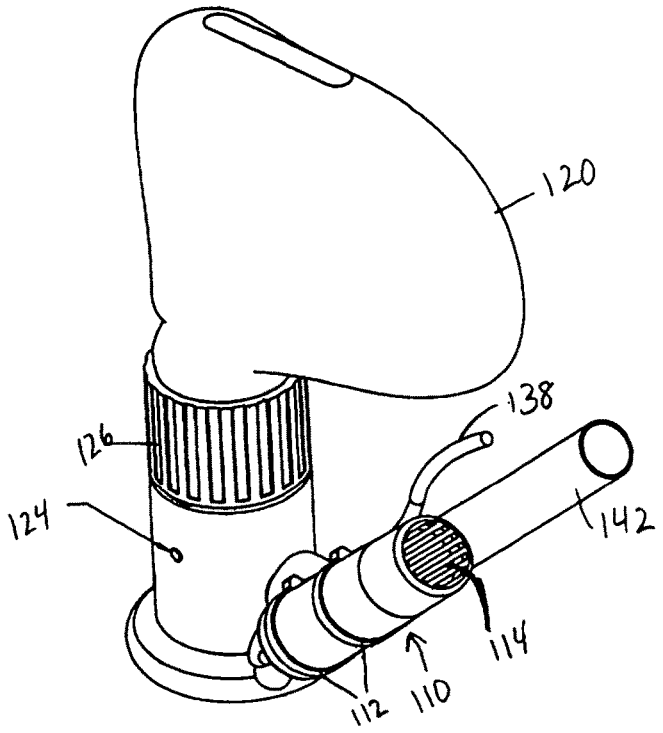
FIG. 9 is another perspective view of the apparatus of FIG. 7.
Figure 10:
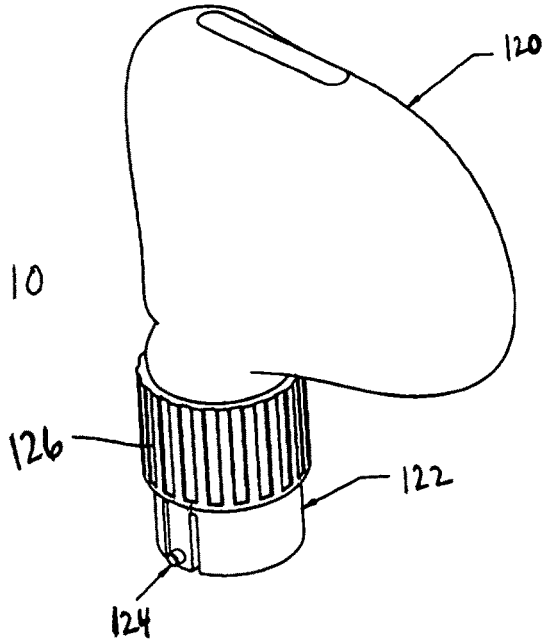
FIG. 10 is a perspective view of a catch bag of the apparatus of FIG. 7.

Referring to FIGS. 9 and 10, mesh catch bag 120 includes a generally cylindrical collar 122 that is sized for telescopic insertion into the upper opening 106 of housing 102. A pair of diametrically opposed detent springs 124 are provided for receipt inside corresponding openings formed in the housing 102 to securely and releasably connect catch bag 120 to housing 102. Catch bag 120 further includes a ribbed portion 126 to facilitate a user of the device grasping the catch bag for efficient connection to and disconnection from housing 102.

Referring now to FIG. 11, additional details of the fluid communication between pump 110 and housing 102 will be described. Pump 110 includes a pump outlet 116 at the lower end thereof, through which the pressurized water is discharged from the pump. Pump outlet 116 connects to one end of a fluid hose 118, which connects at its opposite end to a manifold inlet 152. The manifold inlet 152 is in fluid communication with an annular manifold 150, which is connected to (or integrated into) the housing 102 at the lower end thereof. In one embodiment, annular manifold 150 has a larger diameter than that of housing 102, but it will be understood by those skilled in the art that the manifold could be formed having the same outer diameter as housing 102, or even a smaller diameter to fit inside of the housing 102. Manifold 150 receives pressurized water through the manifold inlet 152, and directs the pressurized water through its ring-shaped tubular body, as shown in FIGS. 14 and 15. Pressurized water is delivered to the tubular body of manifold 150, and exits through a plurality of spaced apart, generally J-shaped conduits defining jets 154. As shown particularly in FIG. 15, the jets 154 extend inwardly from the tubular manifold, and then project upwardly and inwardly at a predefined angle to discharge water through the inner passageway 108. The angle can range between approximately 5 and 20 degrees, and in one embodiment the angle is approximately 11 degrees relative to the vertical axis. In one specific embodiment, the jets 154 are configured such that the water from each jet passes through the axis of housing 102 at the upper opening 106. The number of jets 154 can range from 2 to 6 jets, and in one embodiment comprise three in number. In another embodiment, there are five jets 154 provided. The size of the discharge openings of the jets 154 can range between approximately 3/32 and 9/64 inches, and in one specific embodiment the jets 154 comprise approximately 1/8" openings. Manifold 150 comprises an annular tube with an inner diameter ranging between approximately 5/16 and 1/2 inches, and in one specific embodiment the inner diameter is approximately 3/8".

Referring now to FIG. 12, the underside of apparatus 100 is shown in more detail. Provided on the underside are a plurality of guiding feet 160, which consist of small protuberances extending from the bottom of apparatus 100. In this manner, there is a small gap between the bottom of apparatus 100 and the bottom surface of the spa or other body of water, which allows debris to flow under the body. While in the embodiment shown in FIG. 12 there are four feet 160, it will be understood that the number can vary. In addition, in one specific embodiment the foot 160 at the front end of apparatus 100 (opposite the side with handle mount 140) is removed to prevent the front end of apparatus from falling into grout lines and the line. In this embodiment, the apparatus does not catch on grout lines and the like, and instead glides more smoothly along the bottom surface of the spa.

In operation, similar to apparatus 10, apparatus 100 is submerged into a spa or other body of water, and the power switch 136 is flipped to the on position, thereby activating the motor within the pump 110. Pump 110 draws water in through the intake grate 114 and expels pressurized water through outlet 116, hose 118, and manifold inlet 152. The pressurized water then passes through the ring-shaped tubular fluid conduit of manifold 150, and exits through the plurality of jets 154, in an inward and upward direction dictated by the orientation of the jets 154. The pressurized water is driven through the inner passageway 108 and catch bag 120, and back into the spa. This action forces water inside the inner passageway 108 to be driven upward and out through the upper opening 106, thereby creating a vacuum within the inner passageway 108, which then draws water and debris from underneath housing 102, thereby forcing debris into the catch bag 120 where it is retained.

While certain embodiments and configurations have been described herein, it will be apparent to those having ordinary skill in the art that other embodiments are readily apparent based on the description disclosed herein. Thus, the invention is not to be limited by the foregoing description, but rather by the appended claims and their equivalents.

What is claimed is:

1. An apparatus for cleaning debris from a body of water, the apparatus comprising:

a housing defining an interior passageway having open bottom and top ends;

a power supply mounted to the housing;

a pump mounted to the housing and electrically connected to the power supply, wherein the pump comprises an inlet to draw water from the body of water, and further comprises an outlet;

a catch bag releasably connected to the housing over the open top end; and wherein the housing defines a plurality of openings arranged at a predetermined angle and wherein the outlet is connected to the plurality of openings to deliver water from the pump to the plurality of openings to direct water into the interior passageway and out through the open top end.

2. The apparatus of claim 1 and further comprising an annular manifold in fluid communication with the outlet, and wherein the plurality of openings are spaced along the manifold.

3. The apparatus of claim 2 wherein the openings are between approximately ⅛ and ¼ inches in size.

4. The apparatus of claim 2 wherein the openings are spaced between approximately two and three inches apart.

5. The apparatus of claim 1 wherein the openings are directed at an angle of between approximately 5 and 20 degrees relative to a vertical axis.

6. The apparatus of claim 1 and further comprising a handle mount mounted to the housing, and wherein the power supply is arranged substantially diametrically opposed from the handle mount.

7. The apparatus of claim 1 wherein the plurality of openings comprise generally J-shaped conduits that extend inwardly into the interior passageway and then angle upwardly within the interior passageway.

8. The apparatus of claim 1 wherein the openings are between approximately 5/32 and ¼ inches in diameter.

9. The apparatus of claim 1 wherein the openings extend at an angle of between approximately 5 and 20 degrees relative to the vertical axis.

10. The apparatus of claim 1 and further comprising a plurality of swivel caster wheels connected to the housing.

11. The apparatus of claim 10 wherein the swivel caster wheels extend below the bottom end of the housing.

12. An apparatus for cleaning debris from a body of water, the apparatus comprising:

a housing defining an interior passageway having open bottom and top ends;

a pump mounted to the housing wherein the pump comprises an inlet to draw water from the body of water, and further comprises an outlet;

a power supply in electrical communication with the pump; and wherein the housing is formed having a plurality of openings arranged at a predetermined angle and wherein the outlet is connected to the plurality of openings to deliver water from the pump to the plurality of openings to direct water into the interior passageway and out through the open top end.

13. The apparatus of claim 12 wherein the housing further comprises a plurality of protuberances extending from the bottom of the housing.

14. The apparatus of claim 12 and further comprising an annular manifold at the bottom of the housing, and wherein the openings are formed on the manifold.

15. The apparatus of claim 14, wherein the openings extend inwardly from the manifold and angle upwardly and inwardly to direct water through the interior passageway.

16. The apparatus of claim 12 wherein the housing comprises between 3 and 6 openings.

17. The apparatus of claim 12 wherein the openings direct water at an angle between approximately 5 and 20 degrees relative to the vertical axis.

18. The apparatus of claim 12 wherein the openings are between approximately 3/32 and 9/64 inches in diameter.

19. The apparatus of claim 12 and further comprising a catch bag releasably connected to the open top end.

20. The apparatus of claim 12 and further comprising a pole releasably connected to the housing, and wherein the power supply is configured for being attached to the pole, and further comprising a wire harness electrically coupling the power supply to the pump.

* * * * *